US005913379A

United States Patent [19]

Young et al.

[11] Patent Number: 5,913,379

[45] **Date of Patent: *Jun. 22, 1999**

[54] ARTICULATED AERIAL WORK PLATFORM SYSTEM

[75] Inventors: Paul E. Young; David P. Engvall, both of St. Joseph, Mo.

[73] Assignee: Figgie International, Inc., Willoughby, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/592,585

[22] Filed: Jan. 26, 1996

[51] Int. Cl.[6] ..... B66F 11/04

[52] U.S. Cl. ..... 182/2.7; 182/2.1; 182/69.6

[58] Field of Search ..... 182/2, 63, 2.9, 182/63.1, 69.6, 2.7, 2.1

[56] References Cited

U.S. PATENT DOCUMENTS 3,190,391 6/1965 Hoard ..... 182/2

3,834,488 9/1974 Grove ..... 182/2

5,584,356 12/1996 Goodrich ..... 182/63

*Primary Examiner*—Alvin Chin-Shue

*Attorney, Agent, or Firm*—Senniger, Powers, Leavitt & Roedel

[57] ABSTRACT

An articulated aerial platform system having a lift assembly including an upper parallelogram riser and a lower parallelogram riser. The upper and lower risers are raised and lowered by a single riser cylinder mounted between a base of the system and the upper riser. Relative pivoting motion of the upper and lower risers is controlled by a timing link interconnecting the upper and lower risers. A work platform mounted at the end of a jib pivotally connected to a telescoping boom pivotally connected to the upper riser is leveled for boom motion by operation of a master cylinder and slave cylinder arrangement. The slave cylinder is disposed in a generally vertical position. A jib cylinder actuating motion of the jib is connected across the diagonal of the jib.

13 Claims, 8 Drawing Sheets

ARTICULATED AERIAL WORK PLATFORM SYSTEM

BACKGROUND OF THE INVENTION

This invention relates generally to aerial work platforms and more particularly to an articulated aerial work platform system.

Aerial platforms of the type to which the present invention relates have a base including a turntable on which is mounted a lifting structure and a work platform arranged for lifting by the lifting structure. Thus, the platform can be raised and lowered, and turned around on a generally vertical centerline of the turntable. These movements of the platform are typically controlled by a passenger from a control panel in the platform. Movement of the platform must be relatively precise, particularly in situations where the operating space is small. In the past, the speed of movement of the platform varied significantly over different ranges of motion, making control of motion more difficult. In many situations, including for example when the aerial platform is used for lifting persons up to the wings of aircraft, the operating passenger needs to be certain of the location of the lifting structure around the platform. Lifting structure in proximity to the platform which projects substantially below the floor of the platform cannot be seen by the passenger and may inadvertently strike the wing or other structure near the platform.

In addition to navigating the platform itself, the passenger must be aware of the location and movements of the platform lifting structure (e.g., booms and risers) farther below him. Thus, it is highly desirable to keep the movements of the lifting structure within a defined volume in which they are free to move without hitting any adjacent structure. The defined volume is usually the upward projection of the turntable or base. The characteristic of the lifting structure to extend laterally outside this volume in a raised position is known as "tailswing" or "frontswing", depending upon the direction which the lifting structure leaves the volume.

Frequently, such aerial platforms are mobile and have to that end a chassis and wheels comprising their base. The platform is capable of movement from one location to another for use. The lifting structure should not be mounted so that in its lowered or stowed position the lifting structure projects substantially away from the base, making it difficult to maneuver the aerial platform to a new location. Supporting a platform at substantial distances away from the base requires substantial strength in the lifting structure, not only to resist bending moments but also torsion. Merely adding material to the lifting structure is not a satisfactory solution to the requirement of strength because of the weight added to the lifting structure.

SUMMARY OF THE INVENTION

Among the several objects and features of the present invention may be noted the provision of an articulated aerial platform system which is capable of maintaining a substantially constant vertical platform velocity over the full range of vertical motion of parallelogram risers of the platform system; the provision of such an aerial platform system which maintains its center of gravity near the centerline of its base as the platform is raised; the provision of such an aerial platform system in which their is a generally linear relationship between the extension of a lift cylinder of the system and the vertical position of the platform; the provision of such an aerial platform system which has fewer component parts; the provision of such an aerial platform system is of rigid construction; the provision of such an aerial platform system which is resistant to torsion; the provision of such an aerial platform system which has a compact stowed position; the provision of such an aerial platform system in which structure supporting the platform is protected from engaging surrounding structure; and the provision of such an aerial platform assembly which is economical to manufacture.

Generally, an articulated aerial work platform system constructed according to the principles of the present invention comprises a base, a work platform, and a lift assembly on the base for lifting and lowering the work platform. The lift assembly includes a lower riser comprising a parallelogram. A lower end of the lower riser is connected to the base for pivotal movement of the riser with respect to the base. An upper riser comprising a parallelogram has a lower end connected to an upper end of the lower riser for pivotal movement of the upper riser with respect to the lower riser. An extensible and retractable power actuator, having a lower end connected to the base and an upper end connected to the upper riser, is extensible to pivot the upper and lower risers to raised positions and retractable to pivot the upper and lower risers to lowered positions. A timing mechanism interconnecting the upper and lower risers maintains the pivotal movement of the upper and lower risers in timed relation to one another as they move between their respective raised and lowered positions.

In another aspect of the present invention, a boom and jib system comprising a boom having an inner end mounted for pivotal movement of the boom between raised and lowered positions, and a jib comprising a parallelogram including upper and lower parallel arms having inner ends pivotally connected to an outer end of the boom. A platform connecter member at the outer ends of said upper and lower arms is connected at a first pivot connection to an outer end of the upper arm of the jib for relative pivotal movement therebetween about a first generally horizontal axis. A second pivot connection between an outer end of the lower arm of the jib and the connector member permits relative pivotal movement therebetween about a second generally horizontal axis spaced from said first generally horizontal axis. A first extensible and retractable power actuator can pivot the jib between raised and lowered positions relative to the outer end of the boom while the parallelogram of the jib maintains the connector member in a substantially fixed angular orientation as the jib moves between its raised and lowered positions. A work platform assembly comprising a floor for supporting a worker, is connected to the connector member at a third pivot connection for pivotal movement of the work platform assembly relative to the connector member about a third generally horizontal axis spaced from said first and second generally horizontal axes. An second extensible and retractable power actuator having an upper end connected to the work platform assembly, and a lower end. A fourth pivot connection between the lower end of the second power actuator and the connector member permits pivotal movement of the lower end of the second power actuator relative to the connector member about a fourth generally horizontal axis spaced from said first, second and third generally horizontal axes. The arrangement is such that extension of the second power actuator is adapted to pivot the work platform assembly in one direction about said third pivot axis and retraction of the second power actuator is adapted to pivot the work platform assembly in an opposite direction about said third pivot axis. The fourth pivot connection and second power actuator are disposed outwardly of said third pivot connection toward the work platform assembly. The second power actuator is operable to maintain the floor of the work platform assembly generally horizontal as said boom pivots between its said raised and lowered positions.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
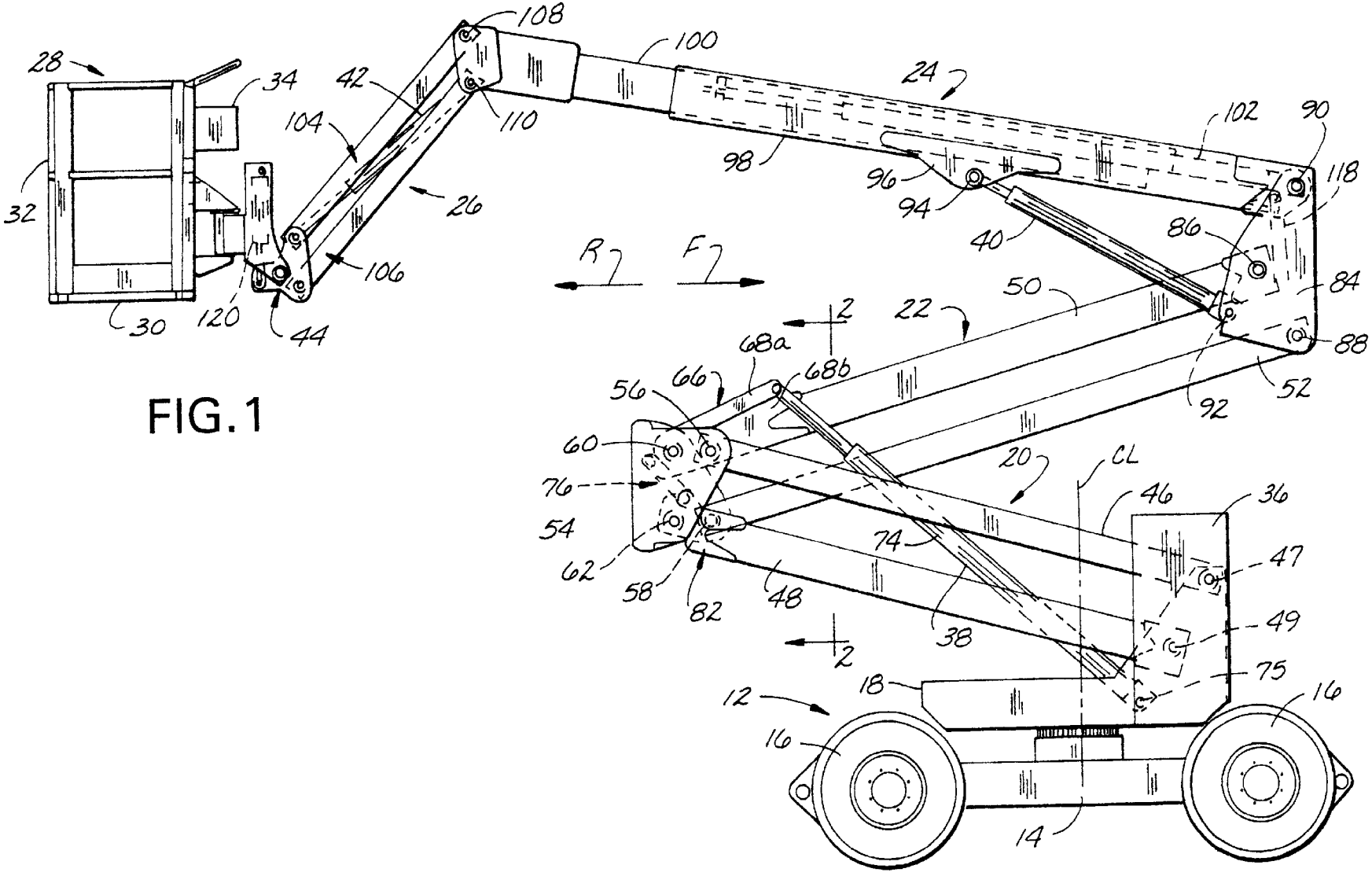
FIG. 1 is a schematic elevational view of an articulated aerial platform system of the present invention in a partially raised position.
Figure 4:
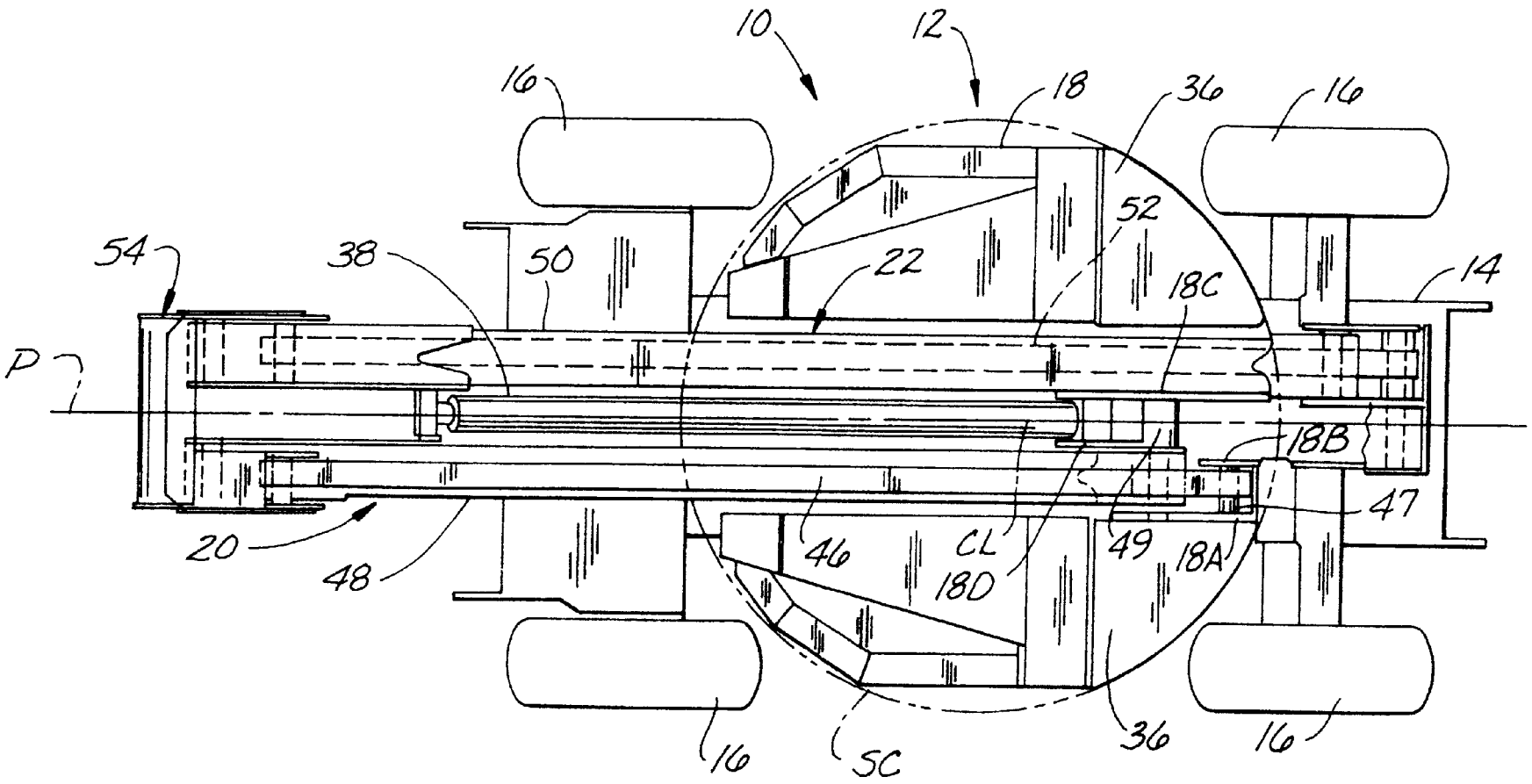
FIG. 4 is a top plan view of the aerial platform system in its stowed position with a boom of the platform system removed.

Referring now to the drawings and in particular to FIGS. 1 and 4 mobile lift machine (broadly, "an articulated aerial work platform system") is generally indicated at 10. The lift machine 10 of the present invention is shown to comprise a base, generally indicated at 12, including a chassis 14, wheels 16 and a turntable 18 rotatably mounted on the chassis. A motor (not shown) would also be mounted on the chassis 14 for driving the rotation of the turntable 18 and the pump for the hydraulic cylinders described hereinafter. A lift assembly including a lower riser 20, an upper riser 22, a boom 24 and jib 26 (all designated generally by their respective reference numbers), supports a work platform, generally indicated at 28, at an upper end of the lift assembly and is mounted at its lower end on the turntable 18. It is to be understood that a lift assembly may include or exclude the boom 24 and jib 26 and still fall within the scope of the present invention. The work platform 28 includes a floor 30, a barrier 32 around the perimeter of the floor and a control panel 34 mounted on the barrier from which operation of the lift machine 10 may be controlled by a worker (not shown) on the work platform. A pair of counterweights 36 are mounted on the side of the turntable 18 farthest away from the work platform 28 to counterbalance the loads carried by the work platform at a distance from the centerline of rotation CL of the turntable.

The lift assembly is powered by hydraulic cylinders for raising and lowering the work platform 28. More specifically, a hydraulic riser cylinder 38 is extensible for to pivot the lower and upper risers 20, 22 to a raised positions and retractable to pivot the lower and upper risers to lowered (stowed) positions. The riser cylinder 38 is pivotally connected at its lower end to the turntable 18 and at its upper end to the upper riser 22. A boom lift cylinder 40 is operable to raise and lower the boom 24 relative to the lower and upper risers 20, 22. A jib cylinder 42 for raising and lowering the jib 26 relative to the free end of the boom 24 is pivotally connected at one end to the boom and at its opposite end to a platform connector (indicated generally at 44) connecting the jib to the work platform 28.

The lower riser 20 comprises a parallelogram including an upper tension beam 46 and a lower compression beam 48 connected by pivot connections (designated 47 and 49, respectively) at their lower ends to the turntable 18 for pivotal movement of the lower riser with respect to the turntable. The pivot connection 47 connecting the upper tension beam 46 to the turntable 18 extends between a first wall 18A and a second wall 18B projecting upwardly from the turntable. The pivot connection 49 connecting the lower compression beam 48 to the turntable 18 extends between the first wall 18A and a third wall 18C projecting upwardly from the turntable. The riser cylinder 38 is pivotally connected to the turntable 18 between a gusset 18D projecting upwardly from the turntable and the third wall 18C. The upper tension beam 46 is disposed above the lower compression beam 48 in the same vertical plane as the lower compression beam. The upper riser 22 is a parallelogram comprising an upper compression beam 50 and a lower tension beam 52. The upper compression beam 50 is disposed above the lower tension beam 52 in the same vertical plane as the lower tension beam. The upper ends of the lower riser beams 46, 48 and the lower ends of the upper riser beams 50, 52 are all connected at spaced apart locations on a riser bracket, generally indicated at 54, such that the riser bracket connects the upper riser 22 to the lower riser 20. More specifically, the upper tension beam 46 of the lower riser is pivotally connected by a pivot connection 56 to the riser bracket 54 and the lower compression beam 48 is pivotally connected by a pivot connection 58 to the riser bracket. Similarly, the upper compression beam 50 of the upper riser 22 is pivotally connected to the riser bracket 54 by a pivot connection 60 and the lower tension beam is pivotally connected to the riser bracket by a pivot connection 62.

Figure 2:
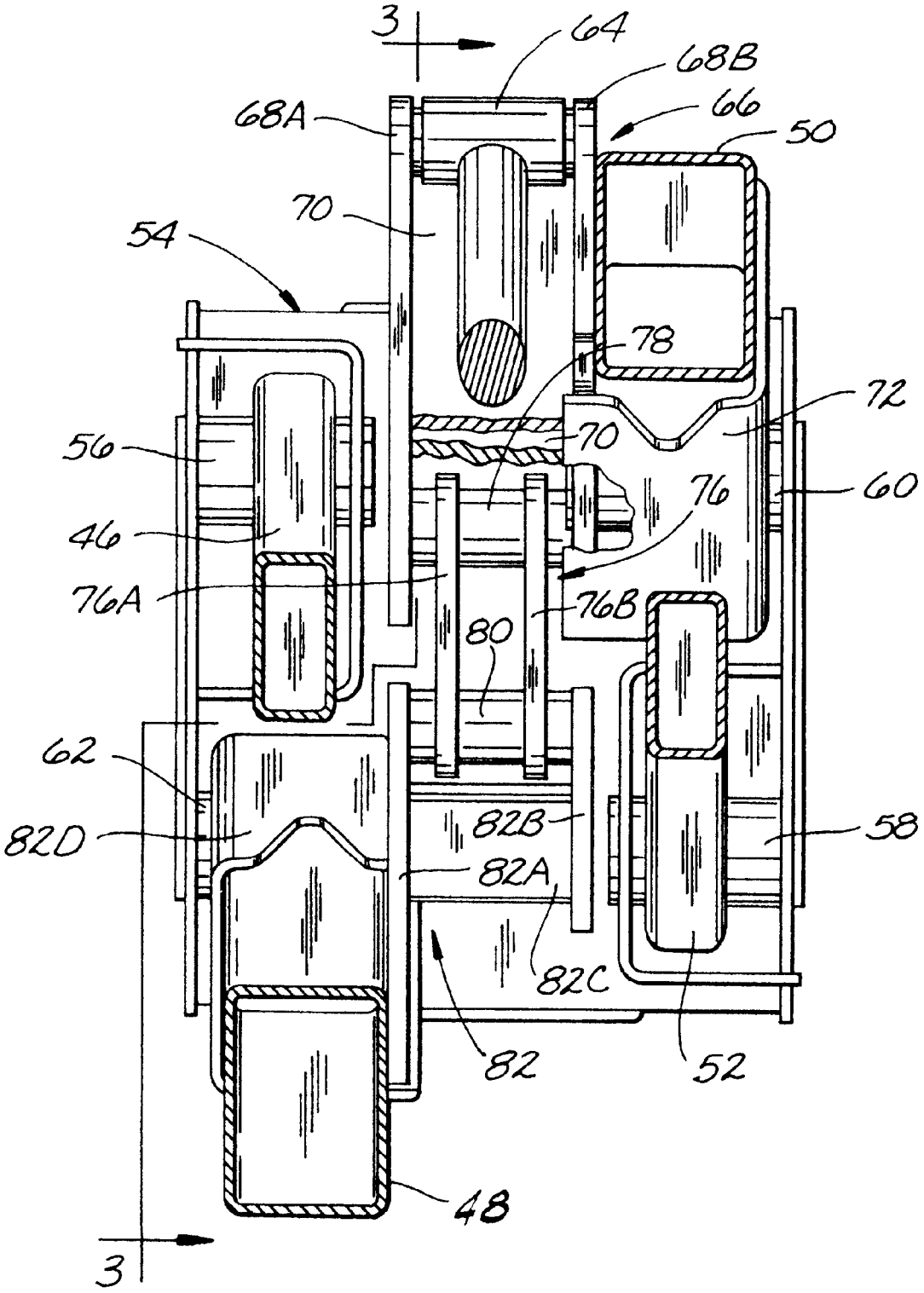
FIG. 2 is a cross section taken in the plane including line 2—2 of FIG. 1.

Referring to FIG. 2, a rod 64 of the riser cylinder 38 is pivotally connected to a first bracket (indicated generally at 66) rigidly attached as by welding to the upper compression beam 50 of the upper riser 22 and, in the preferred embodiment, is the only power actuator driving the raising and lowering motion of the lower and upper risers 20, 22. The first bracket 66 comprises a pair of plates 68A, 68B between which the cylinder rod 64 is pivotally pinned. The plates are joined together by cross members 70, and the right plate 68B (as seen in FIG. 2) is part of a sleeve portion 72 of the first bracket into which the upper compression beam 50 of the upper riser 22 extends and to which the upper compression beam is rigidly attached. A barrel 74 of the riser cylinder 38 is pivotally connected to the turntable 18 by a pivot connection 75. By connecting the riser cylinder 38 directly to the upper riser 22, the relationship between the distance the cylinder's rod 64 extends from its barrel 74 and the height of the work platform 28 is linear. Thus, the rate of motion of the work platform 28 as the lower and upper risers 20, 22 are raised is substantially constant.

Figure 3:
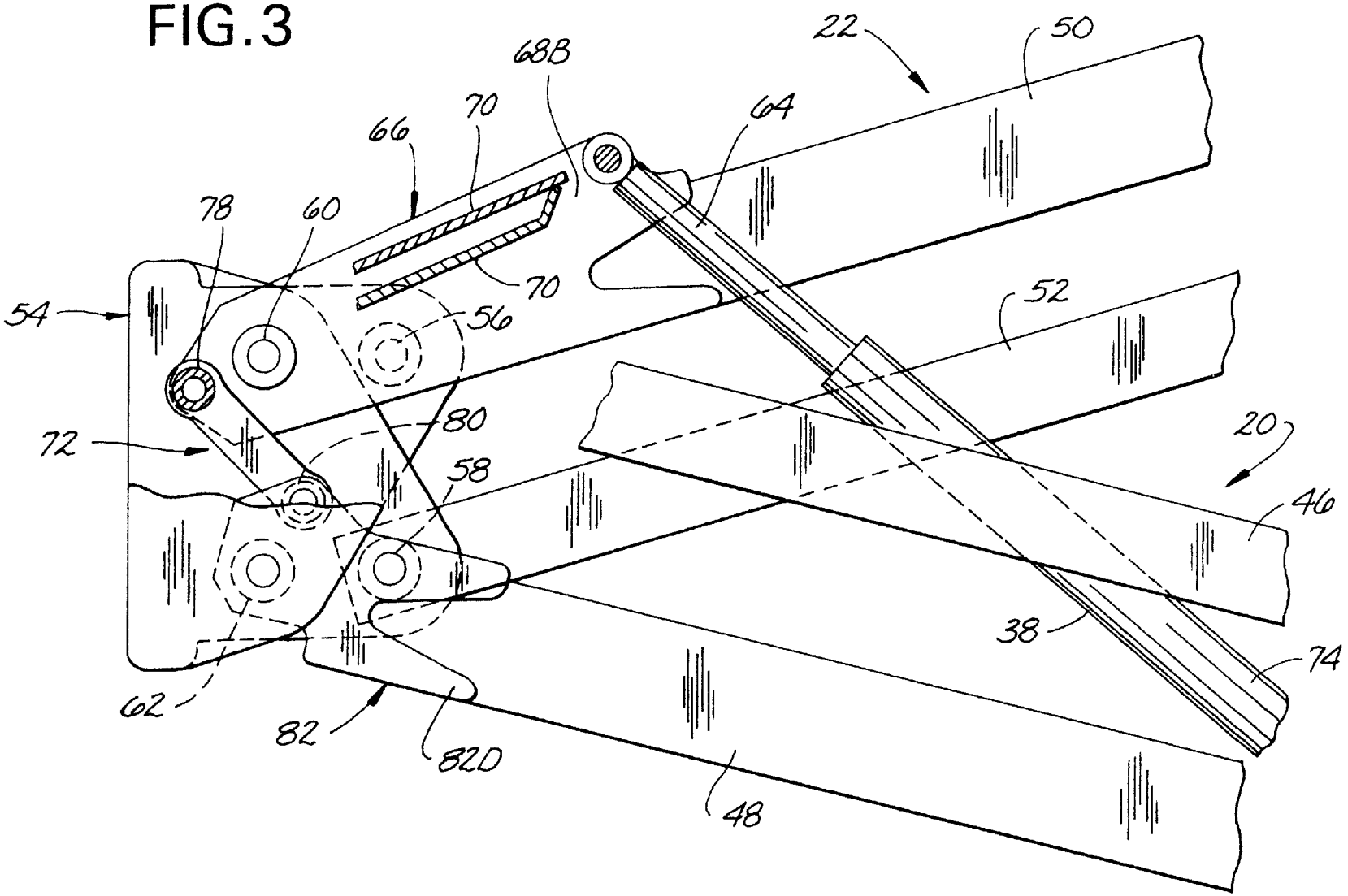
FIG. 3 is a schematic cross section taken along line 3—3 of FIG. 2.

Referring now to FIGS. 2 and 3, a timing link indicated generally at 76 interconnects the upper riser 22 to the lower riser 20 for maintaining the pivotal movement of the lower and upper risers in a timed relation to one another as they move between their respective raised and lowered positions. More specifically, the timing link 76 includes a pair of link elements 76A, 76B pivotally connected at their upper ends to a cylindrical bar 78 fixedly connected between the plates 68A, 68B of the first bracket 66 which is attached to the compression beam 50 of the upper riser 22. The lower ends of the timing link elements 76A, 76B are pivotally connected to another cylindrical bar 80 fixedly attached to a second bracket, generally indicated at 82, which is rigidly secured as by welding to the compression beam 48 of the lower riser 20. The second bracket 82 includes first and second plates 82A, 82B between which extends the bar 80. A structural member 82C extends between the plates 82A, 82B and is fixedly attached to each plate for strengthening the second bracket 82. The left plate 82A (as seen in FIG. 2) forms part of a cup portion 82D of the second bracket 82 in which is received the upper end of the compression beam 48 of the lower riser 20. The compression beam 48 is fixedly connected as by welding to the second bracket 82.

The locations which the respective ends of the timing link 76 is connected to the lower riser 20 and the upper riser 22 are selected to achieve a controlled pivoting motion of the lower and upper risers as they are raised by action of the riser cylinder 38. In the preferred embodiment, the connection of the timing link 76 to the lower and upper risers 20, 22 is selected so that the angular speed of the lower and upper risers as they pivot up from their horizontal stowed position is nearly the same., However in the preferred embodiment, the timing link 76 is pivotally connected to the compression beam 50 of the upper riser 22 at a location slightly closer to the pivot connection 60 of the upper riser than the connection of the timing link to the compression member 48 of the lower riser 20 is to the pivot connection 62. Therefore, the angular speed at which the upper riser 22 pivots upwardly upon extension of the riser cylinder 38 is somewhat faster than that of the lower riser 20.

Figure 6:
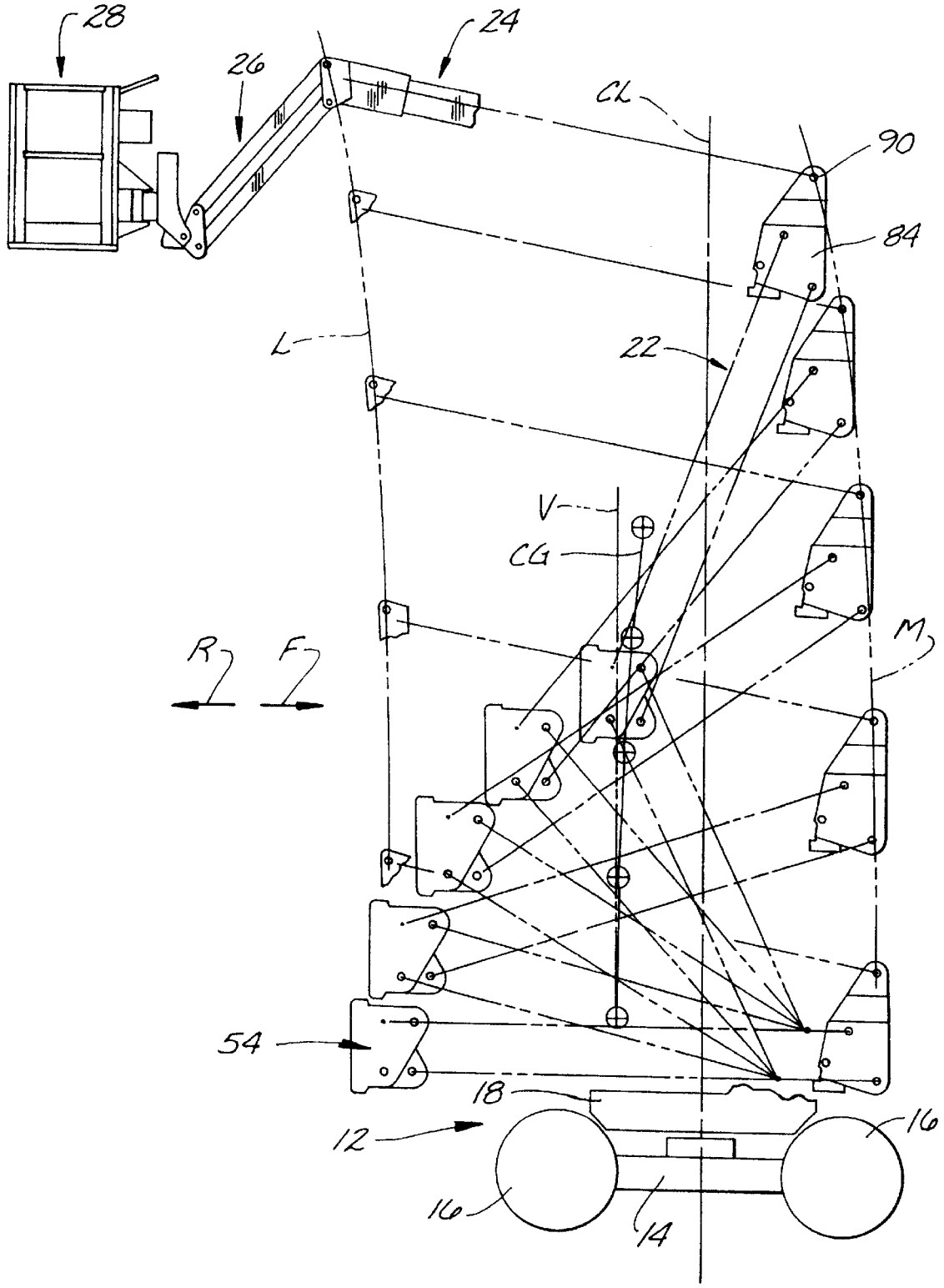
FIG. 6 is a fragmentary, schematic elevational view of the aerial platform system illustrating the motion of the center of gravity of the riser assembly.

As a result of the aforementioned timed relation between the pivoting of the upper riser 20 and the lower riser 22, the boom 24 and the work platform 28 connected thereto move rearwardly (as indicated by curve L in FIG. 6) away from the base 12 as the lower and upper risers 20, 22 are raised. The forward and rearward directions are indicated by arrows R and F in FIGS. 1 and 6. The curve L is parallel to a curve M travelled by the point of connection of the boom 24 to the upper end of the upper riser 22. Thus, the lift machine 10 has a greater lateral reach away from the centerline of rotation CL as the work platform 28 is elevated by the lower and upper risers 20, 22. To offset the rearward load shift created by the rearward movement of the work platform 28, the center of gravity of the riser cylinder 38, lower riser 20 and upper riser 22 moves forwardly as also shown in FIG. 6 toward the centerline CL as the risers are raised so that the lift machine 10 remains balanced. The movement of the center of gravity is illustrated by curve CG in FIG. 6 relative to a vertical line V. It is to be understood that the timing link 76 may be arranged so as to produce different relative pivoting motion between the lower riser 20 and upper riser 22 without departing from the scope of the present invention.

A central vertical plane P of the lift assembly of the lift machine 10 (seen edge on in FIG. 4) passes through the centerline of rotation CL of the turntable 18. For clarity, the boom 24, the boom cylinder 40 and work platform 28 have been removed from FIG. 4. As may be seen, the riser cylinder 38 lies in the central vertical plane P, the parallelogram of the lower riser 20 lies on one side of the plane and the parallelogram of the upper riser 22 lies on the opposite side of the plane. Thus, when the lower and upper risers 20, 22 are stowed they are arranged in a compact, side-by-side relation. The offset arrangement of the lower and upper risers 20, 22 provides a space for the riser cylinder 38 to operate, so that each riser can be constructed of only two beams. It is not necessary to use spaced apart pairs of beams to permit the riser cylinder to extend through the risers for connection to the lift assembly. Moreover, the offset arrangement of the lower and upper risers 20, 22 provides substantial rigidity to the lift assembly, and is particularly resistant to torsion.

Figure 5:
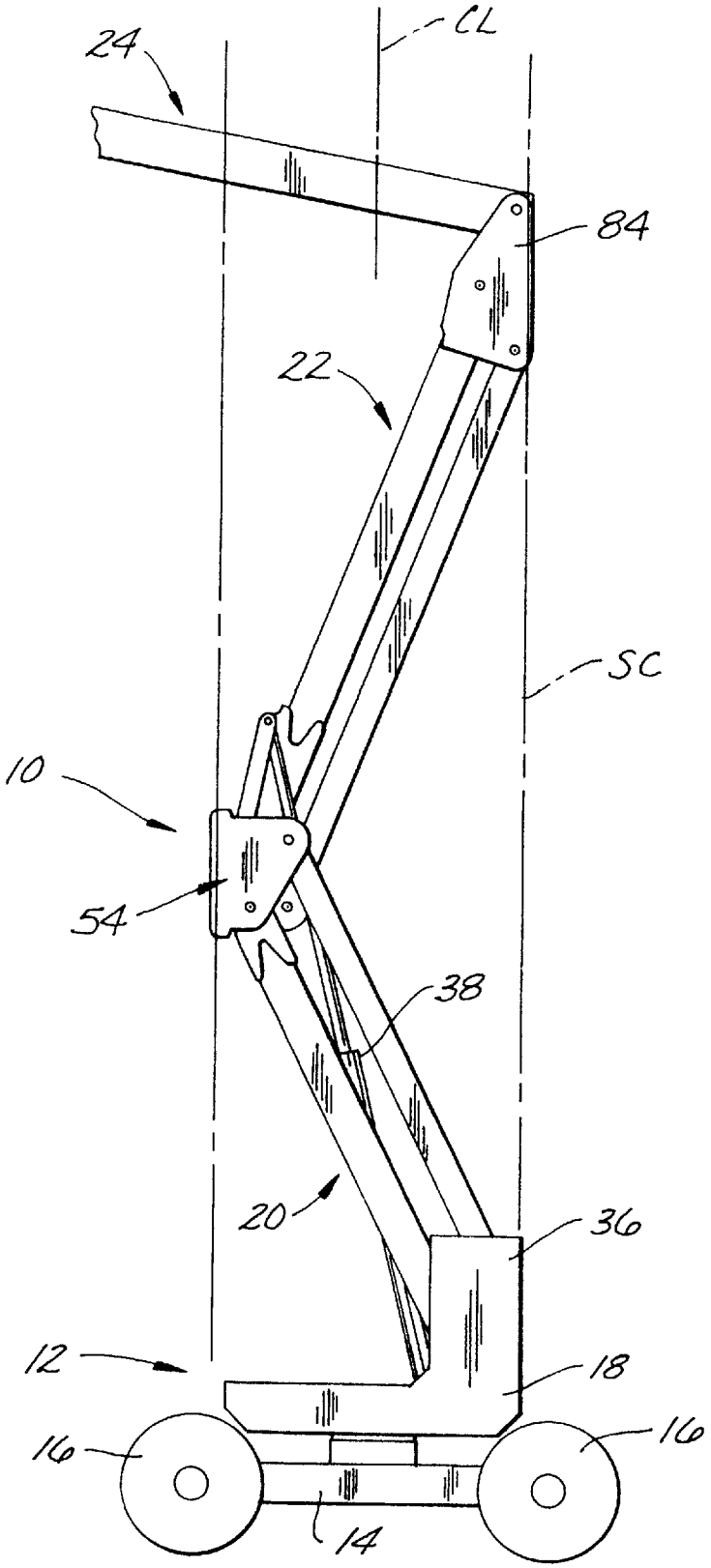
FIG. 5 is a fragmentary, schematic elevational view showing a riser assembly of the aerial platform system in a fully raised position.

Referring to FIGS. 4 and 5, a swing cylinder SC of the lift machine 10 is defined by a vertical projection of a circle having its center on the centerline of rotation CL of the turntable 18 and a diameter approximately equal to the width of the lift machine. As may be seen in FIG. 4, the circle defining the swing cylinder SC generally corresponds to the shape of the turntable 18. In the stowed position, the lift assembly projects both forwardly and rearwardly out of the swing cylinder SC. Thus, the overall length of the lift machine 10 with its lift assembly stowed is kept reasonably small. However, in the fully raised position of the lower and upper risers 20, 22 shown in FIG. 5, the risers are entirely within the swing cylinder SC. The riser bracket 54 and a floating turret 84 connecting the upper riser 22 to the boom 24 project only slightly outside the swing cylinder SC. In the fully raised position of the lower and upper risers 20, 22, there is substantially no tailswing or frontswing of the lower and upper risers (i.e., there are substantially no portions of the risers, riser bracket 54 and floating turret 84 which extend outside the swing cylinder SC). Accordingly, the worker on the work platform 28 does not have to be concerned as the lift assembly is rotated about the centerline by the turntable 18 that the lower riser 20 or upper riser 22 will strike structure (not shown) next to the lift machine 10.

As shown in FIG. 1, the upper end of the compression beam 50 of the upper riser 22 is pivotally connected to the floating turret 84 by a pivot connection 86 and the upper end of the tension beam 52 is pivotally connected to the floating turret by a pivot connection 88 at a location spaced from the pivot connection 86. Because the upper riser 22 and the lower riser 20 are both parallelograms, the angular orientations of the floating turret 84, boom 24, jib 26 and work platform 28 remain the same as the lower and upper risers are raised and lowered. The boom 24 has an inner end mounted by a pivot connection 90 on the floating turret 84 for pivotal movement between raised and lowered positions. The boom cylinder 40 is pivotally mounted at its barrel end to the floating turret 84 by a pivot connection 92 and pivotally connected at its rod end by a pivot connection 94 to a boom bracket 96 fixedly attached to the boom 24. The boom is capable of telescoping motion and to that end comprises an outer member 98 (pivotally attached to the floating turret 84) and an inner member 100 slidably received within the outer member for extending from and retracting into the outer member. The telescoping motion of the inner member 100 of the boom 24 relative to the outer member 98 is actuated by a hydraulic telescope cylinder 102 (shown in hidden lines) within the outer member. The telescope cylinder 102 is pivotally connected to the floating turret 84 at its barrel end by the same pivot connection 90 attaching the boom 24 to the floating turret. The rod end of the telescope cylinder 102 is connected to the inner member 100.

The jib 26 is a parallelogram including upper and lower parallel arms (designated generally at 104 and 106, respectively) which are pivotally connected at their inner ends by respective pivot connections 108, 112 on the free end of the inner member 100 of the boom 24. As may be seen in FIG. 8, the upper jib arm 104 includes a pair of side-by-side arm members 104A, 104B, and the lower jib arm 106 includes a pair of side-by-side arm members 106A, 106B. The arm members are rigidly connected to one another by respective tubes (designated 112 and 114, respectively) at the location of their pivotal connection to the free end of the boom 24. In addition, the arm members 104A, 104B of the upper arm are connected to each other by a cross plate 116 at their distal ends. The cross plate 116 has been broken away in FIG. 8. The lower end of the jib 26 is pivotally connected by the platform connector 44 to the work platform 28.

The angular orientation of the platform connector 44 and work platform 28 remains unchanged as the jib 26 is raised and lowered because the jib is a parallelogram. However, the boom 24 is not a parallelogram. Accordingly, to maintain the work platform 28 in a fixed, level angular orientation for pivoting movement of the boom 24, a master cylinder 118, a slave cylinder 120 and the platform connector 44 are used (FIG. 1). The master cylinder 118 is pivotally mounted at its barrel end on the floating turret 84, and pivotally connected at its rod end to the outer member 98 of the boom 24. Thus, the raising and lowering of the boom 24 by the boom cylinder 40 creates corresponding extension and retraction of the master cylinder 118. The movement of the master cylinder 118 is transmitted by conventional hydraulic means to the slave cylinder 120 to produce an opposite movement of the slave cylinder. The platform connector 44 permits the slave cylinder 120 to pivot the work platform 28 relative to the platform connector and the jib 26 to keep the work platform level as the boom 24 pivots.

Figure 7:
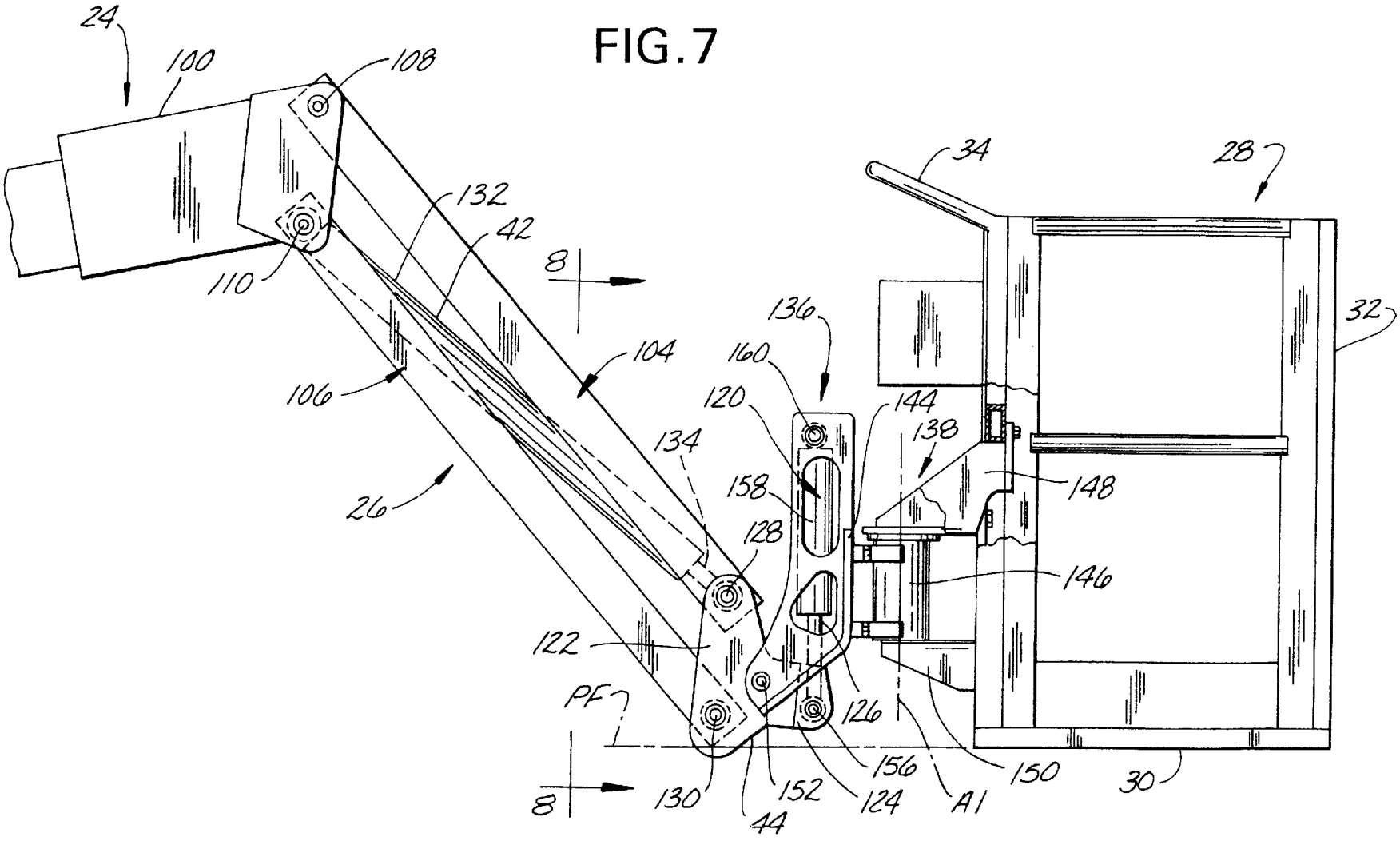
FIG. 7 is an enlarged fragmentary elevational view of the aerial platform system of FIG. 1 showing a jib and work platform of the system.
Figure 8:
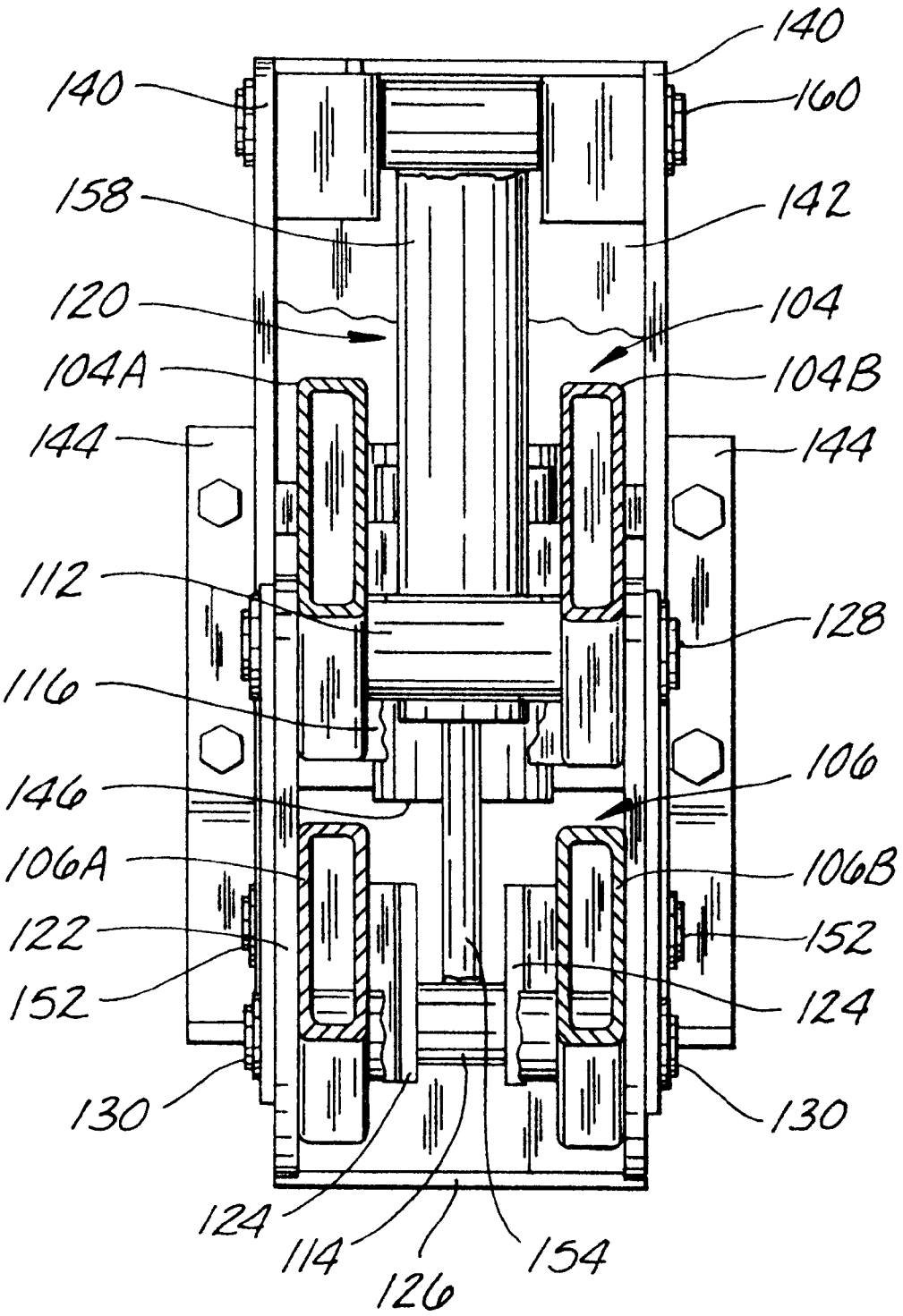
FIG. 8 is a cross section taken in the plane including line 8—8 of FIG. 7, but with the work platform removed.

Referring to FIGS. 7 and 8, the platform connector 44 comprises a pair of side members 122 having the same shape and disposed in laterally spaced, face-to-face relation with each other. The side members 122 include inwardly extending ear portions 124 which are used to pivotally connect the rod end of the slave cylinder 120 to the platform connector 44, as will be described hereinafter. The side members 122 and ear portions 124 are rigidly joined together by a bottom plate 126 so that the platform connector 44 functions as one rigid piece. A first pivot connection 128 connects the outer end of the upper jib arm 104 and the platform connector 44 for pivotal movement relative to each other about a first generally horizontal axis. The lower jib arm 106 is pivotally connected by a second pivot connection 130 to the platform connector 44 for pivotal movement relative to each other about a second generally horizontal axis spaced from the first axis of the first pivot connection 128. A barrel 132 of the jib cylinder 42 is coaxially pivotally connected with the inner end of the lower jib arm 106 to the boom 24, and a rod 134 of the jib cylinder is coaxially pivotally connected with the outer end of the upper jib arm 104 to the platform connector 44 by the first pivot connection 128. The connection of the rod 134 to the first pivot connection 128 has been removed for clarity in FIG. 8. Thus, the jib cylinder 42 extends across the diagonal of the jib 26, maximizing the range of pivoting motion of the jib about the end of the boom 24.

The work platform 28 is connected to the platform connector 44 at the outer end of the jib 26 by a cylinder bracket and a swing bracket (designated generally by reference numerals 136 and 138, respectively). In the preferred embodiment, the work platform 28, cylinder bracket 136 and swing bracket 138 constitute "a work platform assembly". The cylinder bracket 136 and swing bracket 138 are interconnected so as to permit the work platform 28 to swing from side to side about a vertical axis A1 (FIG. 7). The cylinder bracket 136 comprises a pair of mounting plates 140 rigidly joined together by a crosspiece 142 (partially broken away in FIG. 8) attached to each mounting plate as by welding. A flange 144 on each mounting plate 140 strengthens the plate. A hydraulic rotary actuator 146 of the cylinder bracket 136 is fixedly attached to the flanges 144 of the mounting plates. As shown in FIG. 7, the swing bracket 138 comprises upper and lower members (designated 148 and 150, respectively) which are fixedly attached to the work platform 28 and pivotally connected to the rotary actuator 146 so that work platform may be turned from side to side about axis A1 by operation of the rotary actuator.

A third pivot connection 152 connects the cylinder bracket 136 to the platform connector 44 for pivotal movement of the work platform 28 about a third generally horizontal axis spaced from the first and second axes associated with the first pivot connection 128 and second pivot connection 130, respectively. The slave cylinder 120 is attached in a substantial vertical position between the mounting plates 140 and close to the work platform 28 so that the slave cylinder is substantially protected from contacting objects next to the work platform. A rod 154 of the slave cylinder 120 is connected by a fourth pivot connection 156 (FIG. 7) to the ear portions 124 of the platform connector 44 for pivotal movement relative to the platform connector about a horizontal axis spaced from the horizontal axes of the first, second and third pivot connections 128, 130, 152. A barrel 158 of the slave cylinder 120 is connected between the mounting plates 140 of the cylinder bracket 136 by a fifth pivot connection 160 for pivotal movement relative to the platform connector 44 about a horizontal axis spaced from the horizontal axes associated with the first, second, third and fourth pivot connections 128, 130, 152, 156. Extension of the cylinder rod 154 from the barrel 158 causes the work platform 28 to rotate in a counterclockwise direction (as seen in FIG. 7) about the third pivot connection 152, and retraction of the rod into the barrel causes the work platform to rotate in a counterclockwise direction about the third pivot connection. The motion of the work platform 28 actuated by the slave cylinder 120 is responsive to the pivoting movement of the boom 24 (as detected by the master cylinder 118) to keep the work platform level. The construction of the platform connector 44 and slave cylinder bracket 136 results in the slave cylinder 120 remaining in a substantially vertical position for the full range of pivoting motion of the boom 24. In the preferred embodiment, the slave cylinder 120 swings only in an arc of about three degrees from the vertical.

The first pivot connection 128 is located above the second pivot connection 130 and also above the third pivot connection 152. The location of the third pivot connection 152, connecting the work platform 28 to the platform connector 44 permits the second pivot connection 130 and substantially all of the platform connector to remain above the plane PF of the floor of the work platform throughout the full range of relative motion between the platform connector and work platform. The fourth pivot connection 156 is located outward from and below the third pivot connection 152, but at a generally higher location than the second pivot connection 130. The vertical orientation of the slave cylinder 120 is achieved by the location of the fourth pivot connection 156. The vertical orientation of the slave cylinder 120 does not require substantial horizontal distance in which to operate. Therefore, the outer end of the jib 26 may be positioned closer to the platform 28 than if the slave cylinder were horizontally oriented. It is desirable to keep the distance between the outer end of the jib 26 and the platform 28 as short as possible to reduce bending moments and stresses in the platform connector. As a result of the reduced stresses, less material is required in the platform connector 44 and its weight can be reduced. The separation of the third pivot connection 152 from the first and second pivot connections 128, 130 also permits the rod 134 of the jib cylinder 42 to be readily coaxially mounted on the first pivot connection 128 with the upper jib arm 104. This permits the jib cylinder 42 to extend across the diagonal for maximizing the throw of the jib 26.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An articulated aerial work platform system comprising a base, a work platform, and a lift assembly on the base for lifting and lowering the work platform, said lift assembly comprising:

a lower riser comprising a parallelogram, said lower riser having a lower end connected to the base for pivotal movement of the riser with respect to the base, and an upper end, an upper riser comprising a parallelogram, said upper riser having a lower end operatively connected to the upper end of the lower riser for pivotal movement of the upper riser with respect to the lower riser, and an upper end, an extensible and retractable power actuator having a lower end connected to the base, and an upper end connected to the upper riser, said actuator being extensible to pivot the upper and lower risers to raised positions and retractable to pivot the upper and lower risers to lowered positions, the relationship between an extension distance of the actuator and a height of the work platform being linear, and a timing link mechanism interconnecting the upper and lower risers for maintaining the pivotal movement of the upper and lower risers in timed relation to one another as they move between their respective raised and lowered positions, said timing link mechanism comprises a timing link connected at its upper end to an upper beam of the upper riser and connected at its lower end to a lower beam of the lower riser.

2. A system as set forth in claim 1 wherein said power actuator comprises a hydraulic cylinder.

3. A system as set forth in claim 1 wherein said power actuator lies in a central vertical plane of the lift assembly.

4. A system as set forth in claim 3 wherein the parallelogram of said lower riser is disposed entirely on one side of said central vertical plane and the parallelogram of said upper riser is disposed entirely on an opposite side of said central vertical plane.

5. A system as set forth in claim 4 wherein each of said parallelograms comprises a pair of beams disposed one above the other in a vertical plane on a respective side of said central vertical plane.

6. A system as set forth in claim 1 wherein said timing link extends generally parallel to a central vertical plane of the lift assembly and has an upper end pivotally connected to the upper riser and a lower end pivotally connected to the lower riser.

7. A system as set forth in claim 6 further comprising a riser bracket, the lower end of the upper riser and the upper end of the lower riser being pivotally connected to the riser bracket at spaced apart locations, the timing link interconnecting the upper and lower risers at locations selected so that upon extension of the power actuator the upper riser pivots upward faster than the lower riser pivots upward.

8. A system as set forth in claim 1 wherein said base comprises a turntable structure rotatable on a generally vertical axis, said turntable structure having an outer periphery defining a circle which, when projected upwardly, defines a swing cylinder, said lift assembly being mounted on said turntable structure for rotation therewith and being so configured that when it is in a fully lowered or stowed position, it projects in a forward direction and a rearward direction beyond said swing cylinder, and when it is in a fully raised position, it lies entirely within said swing cylinder.

9. A system as set forth in claim 1 wherein said upper and lower risers and said power actuator have a center of gravity which moves upwardly in a forward direction as the upper and lower risers move from their respective lowered positions toward their respective raised position, and wherein said work platform moves in a rearward direction as it moves up from a lowered position, said upward and forward movement of said center of gravity serving to offset said upward and rearward movement of the work platform to increase the stability of the system.

10. An articulated aerial work platform system comprising a base, a work platform, and a lift assembly on the base for lifting and lowering the work platform, said lift assembly comprising:

a lower riser comprising a parallelogram, said lower riser having a lower end connected to the base for pivotal movement of the riser with respect to the base, and an upper end, an upper riser comprising a parallelogram, said upper riser having a lower end operatively connected to the upper end of the lower riser for pivotal movement of the upper riser with respect to the lower riser, and an upper end, an extensible and retractable power actuator having a lower end connected to the base at a location adjacent the connection of the lower riser to the base, and an upper end connected to the upper riser, said actuator being extensible to pivot the upper and lower risers to raised positions and retractable to pivot the upper and lower risers to lowered positions, said actuator extending from the base upwardly across the lower riser, and a timing link mechanism interconnecting the upper and lower risers for maintaining the pivotal movement of the upper and lower risers in timed relation to one another as they move between their respective raised and lowered positions, said timing link mechanism comprises a timing link connected at its upper end to an upper beam of the upper riser and connected at its lower end to a lower beam of the lower riser.

11. A system as set forth in claim 10 wherein said timing link extends generally parallel to a central vertical plane of the lift assembly and has an upper end pivotally connected to the upper riser and a lower end pivotally connected to the lower riser.

12. A system as set forth in claim 11 further comprising:

a telescoping boom having an inner end operatively connected to the upper end of the upper riser for pivotal movement of the boom between raised and lowered positions, and an outer end, a jib having an inner end pivotally connected to the outer end of the boom, and an outer end, said work platform being connected to the jib at its outer end, and an extensible and retractable boom power actuator having a lower end connected to the upper riser and an upper end connected to the boom, said actuator being extensible to pivot the boom to a raised position and retractable to pivot the boom to a lowered position.

13. A system as set forth in claim 10 further comprising:

a telescoping boom having an inner end operatively connected to the upper end of the upper riser for pivotal movement of the boom between raised and lowered positions, and an outer end, a jib having an inner end pivotally connected to the outer end of the boom, and an outer end, said work platform being connected to the jib at its outer end, and an extensible and retractable boom power actuator having a lower end connected to the upper riser and an upper end connected to the boom, said actuator being extensible to pivot the boom to a raised position and retractable to pivot the boom to a lowered position.

* * * * *